US008069589B2

(12) United States Patent
Guzman

(10) Patent No.: US 8,069,589 B2
(45) Date of Patent: Dec. 6, 2011

(54) FOOTWEAR WITH LIGHTED LACES

(75) Inventor: Rudy Guzman, Coral Springs, FL (US)

(73) Assignee: BBC International LLC, Boca Raton, FL (US)

( * ) Notice: Subject to any disclaimer, the term of this patent is extended or adjusted under 35 U.S.C. 154(b) by 806 days.

(21) Appl. No.: 12/126,304

(22) Filed: May 23, 2008

(65) Prior Publication Data

US 2009/0288318 A1 Nov. 26, 2009

(51) Int. Cl.
*A43B 23/00* (2006.01)
*A43C 11/00* (2006.01)

(52) U.S. Cl. ..... 36/137; 36/50.1

(58) Field of Classification Search ..... 36/137, 36/132, 136, 50.1
See application file for complete search history.

(56) References Cited

U.S. PATENT DOCUMENTS

| | | | | |
|---|---|---|---|---|
| 1,184,396 | A | 5/1916 | Trimble | |
| 4,651,447 | A * | 3/1987 | Sullivan | 36/137 |
| 4,935,851 | A | 6/1990 | Wood | |
| 5,033,212 | A | 7/1991 | Evanyk | |
| 5,052,131 | A | 10/1991 | Rondini | |
| 5,430,621 | A | 7/1995 | Raskas | |
| 5,438,488 | A | 8/1995 | Dion | |
| D367,954 | S | 3/1996 | Dion | |
| 5,502,903 | A | 4/1996 | Barker | |
| 5,604,999 | A | 2/1997 | Barker | |
| 5,649,758 | A | 7/1997 | Dion | |
| 5,722,757 | A | 3/1998 | Chien | |
| 5,746,500 | A | 5/1998 | Chien | |
| 5,812,063 | A | 9/1998 | Weng et al. | |
| 5,879,069 | A | 3/1999 | Chien | |
| 5,894,201 | A | 4/1999 | Wong | |
| 5,921,653 | A | 7/1999 | Chien | |
| 5,934,784 | A | 8/1999 | Dion | |
| 5,955,957 | A | 9/1999 | Calabrese et al. | |
| 5,969,479 | A | 10/1999 | Wong | |
| 6,012,822 | A | 1/2000 | Robinson | |
| 6,082,867 | A | 7/2000 | Chien | |
| 6,167,599 | B1 | 1/2001 | Chen | |
| 6,286,975 | B1 | 9/2001 | Rodgers | |
| 6,525,487 | B2 | 2/2003 | Wei | |
| 6,906,472 | B2 | 6/2005 | Wong | |
| 7,181,870 | B2 | 2/2007 | Guzman | |
| 7,255,468 | B2 | 8/2007 | Capriola | |
| D550,430 | S | 9/2007 | Martin, Jr. | |
| 7,272,897 | B2 | 9/2007 | Yu | |
| 7,347,010 | B2 | 3/2008 | Yu | |
| 2003/0145494 | A1 * | 8/2003 | Hsu | 36/137 |
| 2003/0231485 | A1 | 12/2003 | Chien | |
| 2004/0100792 | A1 | 5/2004 | Trzecieski | |
| 2004/0103563 | A1 * | 6/2004 | Linge | 36/137 |
| 2005/0018450 | A1 | 1/2005 | Chien | |
| 2005/0257399 | A1 | 11/2005 | Yu | |
| 2006/0053663 | A1 * | 3/2006 | Mao | 36/137 |
| 2006/0196089 | A1 | 9/2006 | Guzman | |
| 2007/0201221 | A1 * | 8/2007 | Cherdak et al. | 362/103 |
| 2008/0250672 | A1 * | 10/2008 | Forbes | 36/137 |

FOREIGN PATENT DOCUMENTS

| | | | |
|---|---|---|---|
| EP | 0 534 560 | A1 | 3/1993 |

* cited by examiner

*Primary Examiner* — Jila Mohandesi
(74) *Attorney, Agent, or Firm* — GrayRobinson, P.A.

(57) ABSTRACT

An article of footwear is provided having a decorative lighting arrangement wherein one or more LEDs are mounted within the interior of one or more sleeves, having the appearance of a shoelace, which are located in the toe portion of the shoe.

9 Claims, 2 Drawing Sheets

FOOTWEAR WITH LIGHTED LACES

FIELD OF THE INVENTION

This invention relates to articles of footwear, and, more particularly, to articles of footwear including one or more sleeves, mounted in the toe area, each having the appearance of a shoelace and being formed with a hollow interior within which one or more light sources are mounted that are visible through the sleeves when illuminated.

BACKGROUND OF THE INVENTION

For a number of years, articles of footwear and various items of clothing have been sold with decorative arrays of light sources such as light emitting diodes (LEDs). This has been particularly popular in children's shoes where the LEDs are arranged to complement other design elements of the shoe such as cartoon characters and the like.

In a typical design of an article of footwear of the type noted above, a light module is provided including a plastic housing which is usually mounted within a cavity formed in the heel area of the shoe. The plastic housing contains a battery, a switch and an integrated circuit or other controller which is connected by wires to LEDs located externally of the housing and positioned at desired locations on the outsole, upper or tongue of the shoe. The controller is effective to turn on and off the LEDs, often in a flashing pattern or sequence, to enhance the visual effect and draw attention to the shoe. In many designs, the controller is enabled by the switch that may be operated manually or turned on and off in response to the application of an inertial force, pressure or motion to the shoe. Systems of this type are shown, for example, in U.S. Pat. Nos. 6,525,487; 6,286,975; 6,012,822; 5,969,479; 5,894,201 and 5,812,063.

SUMMARY OF THE INVENTION

This invention is directed to an article of footwear having a decorative lighting arrangement wherein one or more LEDs are mounted within the interior of a sleeve having the appearance of a shoelace. The LEDs, when illuminated, shine light through the sleeve to provide a unique visual effect.

The article of footwear of this invention comprises an outsole connected to an upper having a toe portion, a heel portion, an interior and an opening into the interior that extends between the toe and heel portions. The upper is formed with first and second sides separated by a tongue. One or more hollow sleeves, preferably each comprising a section of fabric material that resembles a shoelace, span the opening between the first and second sides of the upper in the toe portion of the shoe. Opposite ends of the sleeves are fixed to one of the first and second sides of the upper to retain them in place. At least one LED is mounted within the interior of each sleeve which is electrically connected to a light module housed in a cavity in the outsole. The light module is effective to illuminate the LEDs causing them to shine light that is visible through the hollow sleeves. Shoelaces or straps, located between the hollow sleeve(s) and the heel portion and heel portion of the shoe, may be employed to secure the upper of the shoe to the foot of a wearer.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
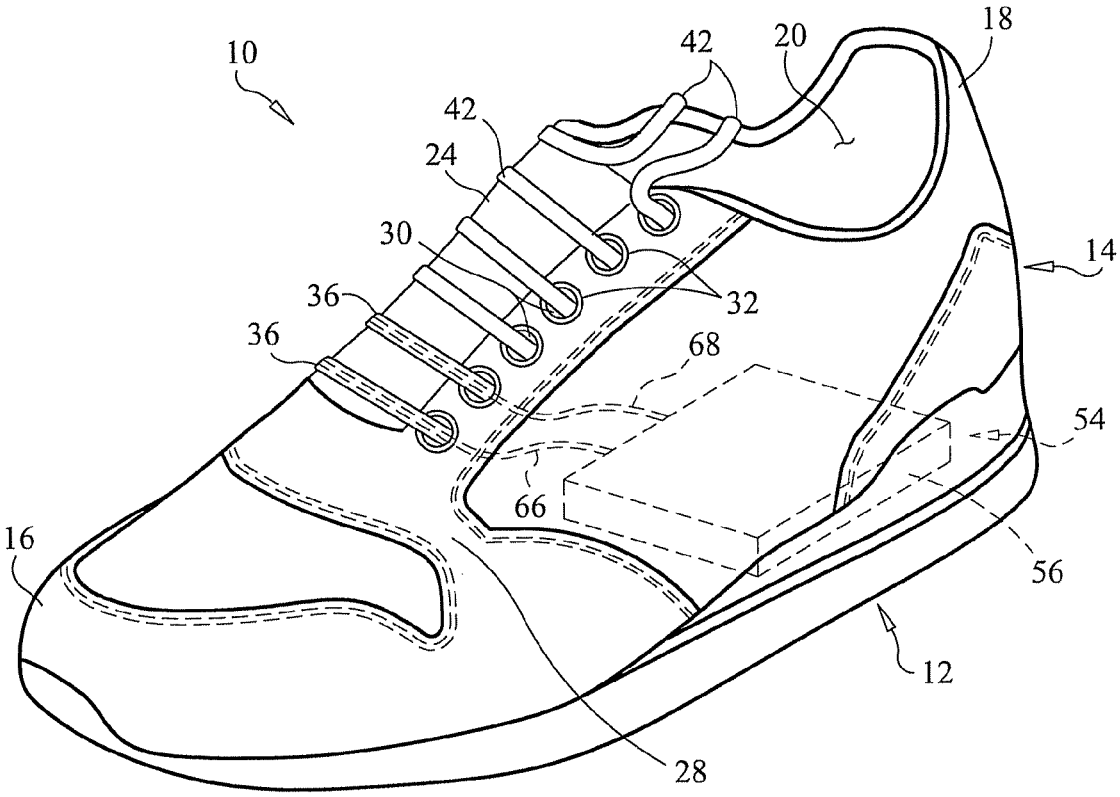
FIG. 1 is a perspective view of the article of footwear of this invention.

Referring now to the drawings, a shoe 10 is depicted having an outsole 12 connected to an upper 14. The upper 14 has a toe portion 16, a heel portion 18, an opening 20 for insertion of the foot into the interior of the shoe 10 and a tongue 24 that divides the upper 14 into a first side portion 26 and a second side portion 28. It should be understood that a shoe 10 is shown to illustrate the structure and operation of the subject invention, and the term "shoe" is intended to be broadly construed to include any article of footwear normally worn on the feet such as boots, sandals etc. Additionally, although a tongue 24 is shown in the Figs., the shoe 10 may be constructed without a tongue 24.

In the embodiment of FIG. 1, the second side portion 28 is formed with a number of spaced openings 30 extending in a direction from the toe portion 16 toward the heel portion 18 of the upper 14. These openings 30 may be provided with eyelets 32. Similarly, a number of identical openings (not shown) are formed in the first side portion 26 opposite to and in alignment with the openings 30.

Figure 2:
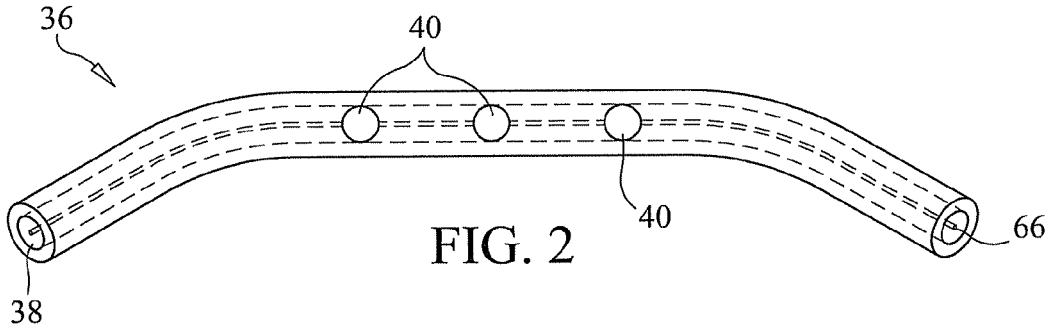
FIG. 2 is a side view of one of the sleeves, having the appearance of a shoelace, showing LEDs mounted within its interior.

A sleeve 36 extends between the first and second side portions 26, 28, across the tongue 24, such that one end of the sleeve 36 is inserted through an opening 30 in the first side portion 26 and its opposite end is inserted through an opening in the second side portion 28 opposite such opening 30. The ends of the sleeve 36 are mounted in a fixed position to the first and second side portions 26, 28, respectively, by adhesive, stitching or other suitable means. As best seen in FIG. 2, the sleeve 36 has a hollow interior 38 within which one or more LEDs 40 are mounted. The LEDs 40 may be of the same or different colors, as desired. The sleeve 36 is preferably formed of a fabric material that closely resembles a shoelace, although it is contemplated that other materials may be employed, such as plastic, so long as light produced by the LEDs 40, as discussed below, is permitted to pass through such material.

Figure 3:
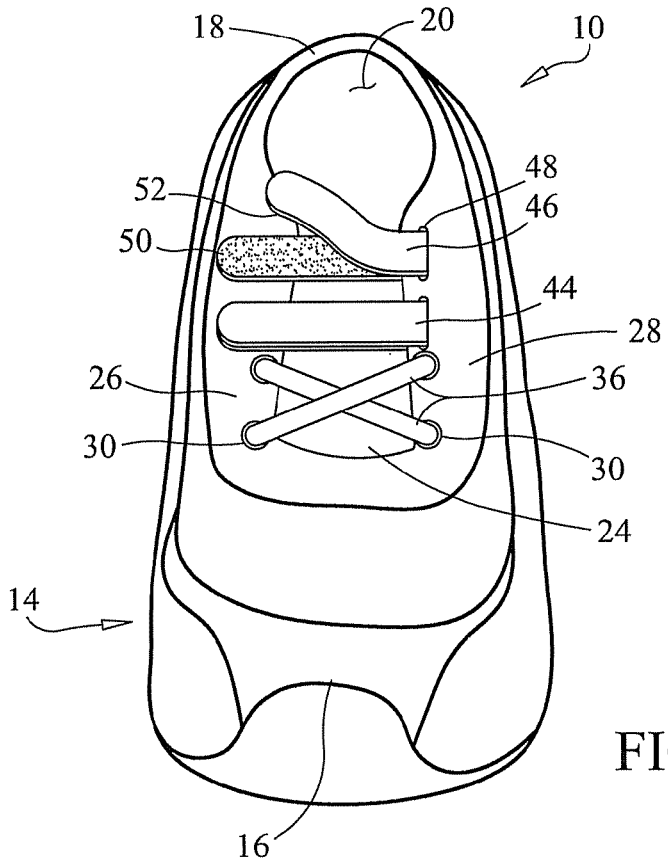
FIG. 3 is a top plan view similar to FIG. 1, except with the sleeves shown crisscrossed and straps for fastening one side of the upper to the other instead of shoelaces.
Figure 4:
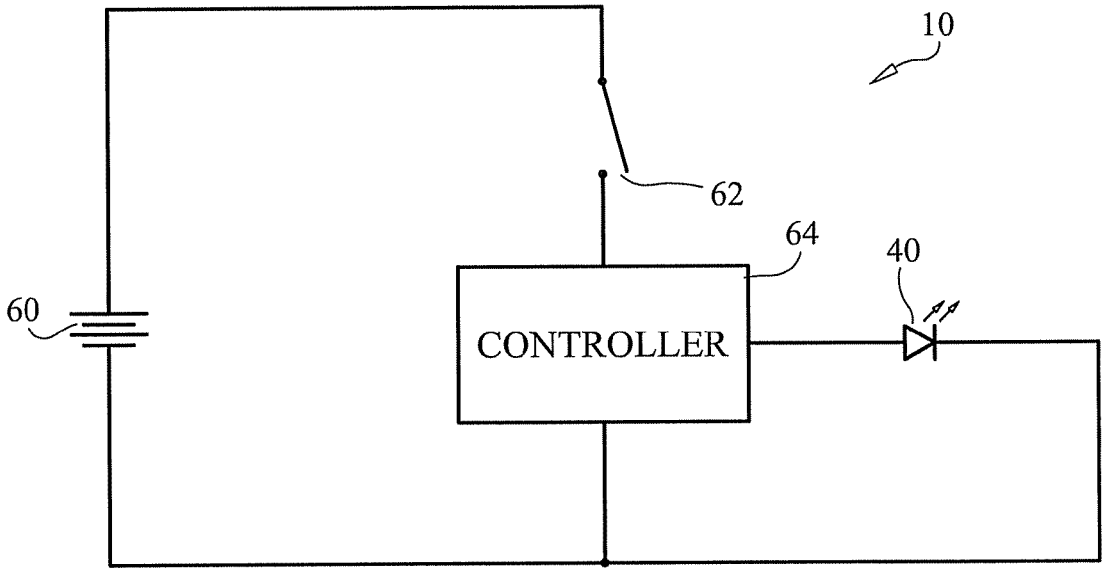
FIG. 4 is a schematic view of an electrical circuit housed in the light module of this invention.

In the embodiment of FIG. 1, two sleeves 36 are mounted to each of the first and second side portions 26, 28, and they are oriented substantially parallel to one another. One of the sleeves extends through the aligning openings 30 in the first and second side portions 26, 28 closest to the toe portion 16 of the upper 14, and then the second sleeve 36 is inserted into the immediately adjacent openings 30. Alternatively, as shown in FIG. 3, the sleeves 36 may criss-cross one another. In both embodiments, each end of the sleeves 36 is fixed to one of the first and second side portions 26, 28, as described above.

In the embodiment of this invention shown in FIG. 1, the openings 30 in the first and second side portions 26, 28 that are not occupied with sleeves 36 receive a standard shoelace 42. The shoelace 42 may be laced to the shoe 10 in a parallel or criss-cross pattern between the side portions 26, 28, and may be tied to retain one's foot within the interior 22 of the shoe 10. In an alternative embodiment shown in FIG. 3, the openings 30 in the first and second side portions 26, 28 are eliminated, except for those occupied by the sleeves 36, and the shoelace 42 is replaced with straps 44 and 46. Although two straps 44, 46 are shown in FIG. 3, it should be understood that three or more straps could be employed, as desired. One end of each strap 44, 46 is fixed to the first side portion 26 and the remainder of each strap 44, 46 extends across the tongue 24 to the second side portion 28 where it is threaded through a slot 48 formed in the second side portion 28. The straps 44, 46 are folded back on themselves, e.g. from the second side portion 28 to the first side portion 26, so that mating hook and loop fastener elements 50, 52 located on the facing surfaces of straps 44, 46 may engage one another to retain the straps 44, 46 in place.

As best seen in Figs, 1 and 4, a light module 54 is mounted within a cavity (not shown) that is formed in the heel area of the outsole 12 over which a sock liner or insole of the shoe 10 is secured. The light module 54 includes a housing 56 that encases an electrical circuit 58 comprising a battery 60, a motion or inertia switch, such as a spring switch 62, and, preferably, a controller 64. At least one wire 66 connects the electrical circuit 58 with the LEDs 40 located in one of the sleeves 36, and at least one second wire 68 connects the electrical circuit 58 with the other sleeve 36. In response to the application of a force or motion to the shoe 10, the spring switch 62 couples the battery 60 to the controller 64. The controller 64, in turn, is effective to illuminate the LEDs 40 within each of the sleeves 36, preferably in a flashing sequence. The LEDs 40 are sufficiently bright to shine light through the material forming the sleeves 36 so as to be readily visible to one looking at the shoe 10. This produces a decorative effect which is aesthetically pleasing, especially for smaller children wearing the shoe 10.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, in the illustrated embodiments, a sleeve 36 is mounted in each of two sets of openings 30 in the first and second side portions 26, 28 of the upper 14. A single sleeve 36 may be employed, or more than two sleeves 36, provided there is sufficient space along the first and second side portions 26, 28 to locate a shoelace 42 or straps 44, 46 so that the shoe 10 may be secured to the foot of a wearer of the shoe 10. Additionally, more openings 30 could be provided for the shoelace 42 than are shown in the Figs., as desired.

Therefore, it is intended that the invention not be limited to the particular embodiment disclosed as the best mode contemplated for carrying out this invention, but that the invention will include all embodiments falling within the scope of the appended claims.

What is claimed is:

1. An article of footwear, comprising:

an outsole;

an upper connected to said outsole, said upper being formed with a toe portion, a heel portion, an interior and an opening into said interior, said opening being defined by a first side portion of said upper and a second side portion of said upper which is spaced from said first side portion, said opening having a first end at said toe portion and a second end spaced from said first end in a direction toward said heel portion;

at least one sleeve having a first end, a second end and a hollow interior, said first end of said at least one sleeve being permanently fixed to said first side portion of said upper and said second end of said at least one sleeve being permanently fixed to said second side portion of said upper so that said at least one sleeve extends across said opening, said at least one sleeve being located proximate to said first end of said opening;

at least one light source mounted within said hollow interior of said at least one sleeve;

a light module mounted to one of said outsole and said upper;

at least one wire electrically connecting said light module to said at least one light source, said light module being effective to illuminate said at least one light source;

a connecting device separate from said at least one sleeve, said connecting device being located between said at least one sleeve and said second end of said opening, said connecting device being releasably coupled to at least one of said first and second side portions of said upper in position to span said opening, said connecting device being adapted to releasably secure the foot of a wearer of the article of footwear within said interior of said upper.

2. The article of footwear of claim 1 in which said at least one sleeve is a section of fabric material.

3. The article of footwear of claim 2 in which said at least one light source, when illuminated, produces light that is visible through said section of fabric material.

4. The article of footwear of claim 1 in which said first side portion of said upper is formed with a number of spaced first eyelets extending from said at least one sleeve toward said heel portion, said second side portion of said upper being formed with a number of spaced second eyelets extending from said at least one sleeve toward said heel portion opposite said spaced first eyelets.

5. The article of footwear of claim 4 in which said connecting device is a shoelace insertable within said first and second eyelets and extending between said first and second side portions of said upper.

6. The article of footwear of claim 1 in which said connecting device is at least one strap connected between said first and second side portions of said upper.

7. The article of footwear of claim 1 in which said at least one sleeve comprises a number of sleeves, oriented substantially parallel to one another.

8. The article of footwear of claim 1 in which said at least one light source is a number of light emitting diodes (LEDs), said light module further including a controller, said controller being effective to cause said LEDs to illuminate in a flashing pattern.

9. The article of footwear of claim 1 in which said at least one sleeve comprises a number of sleeves that criss-cross one another in between said first and second side portions of said upper.

* * * * *